United States Patent [19]

Busch

[11] 4,437,671

[45] Mar. 20, 1984

[54] DUELING INTERACTIVE TARGET SYSTEM

[75] Inventor: Theodore N. Busch, Minneapolis, Minn.

[73] Assignee: Caswell International Corporation, Minneapolis, Minn.

[21] Appl. No.: 346,504

[22] Filed: Feb. 8, 1982

[51] Int. Cl.[3] ..... F41J 5/00

[52] U.S. Cl. ..... 273/372; 273/406; 434/19

[58] Field of Search ..... 273/348, 359, 371–373, 273/310–312, 406; 434/19

[56] References Cited

U.S. PATENT DOCUMENTS

| | | | |
|---|---|---|---|
| 2,404,653 | 7/1946 | Plebanek | 273/101.1 |
| 2,709,592 | 5/1955 | McAvoy | 273/102.2 |
| 2,749,123 | 6/1956 | Ream | 273/102.2 |
| 2,749,124 | 6/1956 | Ream | 273/102.2 |
| 2,749,125 | 6/1956 | Ream | 273/102.2 |
| 2,883,194 | 4/1959 | Bogner et al. | 273/105.6 |
| 3,112,110 | 11/1963 | Schulman | 273/373 |
| 3,304,612 | 2/1967 | Procter et al. | 273/373 |
| 3,411,785 | 11/1968 | Molina et al. | 273/105.1 |
| 3,475,029 | 10/1969 | Hyman | 273/102.2 |
| 3,489,413 | 1/1970 | Groder et al. | 273/102.2 |
| 3,602,510 | 8/1971 | Knippel et al. | 273/102.2 |
| 3,627,323 | 11/1971 | Bozich et al. | 273/102.2 |
| 3,656,056 | 4/1972 | Dalzell, Jr. | 324/65 |
| 3,678,495 | 7/1972 | Gilbert | 340/323 |
| 3,705,725 | 12/1972 | Thalman | 273/373 |
| 3,737,166 | 6/1973 | Knight | 273/102.2 |
| 3,778,059 | 12/1973 | Rohrbaugh et al. | 273/102.2 |
| 3,805,030 | 4/1974 | Wichinsky et al. | 235/92 |
| 3,914,879 | 10/1975 | Taylor et al. | 434/19 |
| 4,129,299 | 12/1978 | Busch | 273/102.2 |
| 4,203,232 | 5/1980 | Knight et al. | 35/25 |
| 4,222,564 | 9/1980 | Allen et al. | 273/369 |
| 4,244,583 | 1/1981 | Wood et al. | 273/373 |
| 4,261,579 | 4/1981 | Bowyer et al. | 273/372 |

*Primary Examiner*—Vance Y. Hum

*Attorney, Agent, or Firm*—Schroeder, Siegfried, Vidas & Arrett

[57] ABSTRACT

A hit indicating system for a multiple target shooting range including individual normally closed impact sensor switches associated with each target and a conductor connecting each of the impact sensors in a series array. Discrimination and logic circuitry are provided for discriminating between hits and "friend" and "foe" targets and for indicating which one of several "friend" or "foe" targets has been struck when the system is used in a night fight simulation mode.

7 Claims, 6 Drawing Figures

DUELING INTERACTIVE TARGET SYSTEM

DESCRIPTION

1. Field of the Invention

This invention relates to a target system for training in the use of rifles, hand guns and similar weapons utilizing a single conductor for interconnecting a plurality of targets and includes discrimination and logic circuitry for determining which of the targets has been struck.

2. Description of the Prior Art

In the prior art, various systems are provided for detecting projectile impacts on a plurality of targets. In many of the systems, a separate pair of conductors is connected to each of the targets. A drawback encountered with such a system is that the conductors are often struck by bullets.

OBJECTS OF THE INVENTION

A primary object of the invention is to provide a low cost and easy to maintain target system for advanced firearms training courses operating interactively and in real time.

Another object of the invention is to provide a target system incorporating a single interconnecting conductor to interconnect each target sensor in a series array to simplify the system electronics and minimize the exposure of wire down range.

The foregoing and other objects of the invention will become apparent in light of the drawings, specification and claims contained herein.

SUMMARY OF THE INVENTION

The target system disclosed herein is comprised of at least one target assembly, each of which includes a hit sensor for providing an output indication at a pair of output terminals when the target assembly is struck and coupling means for connecting the output terminals of each of the hit sensors in a series array and an indicator circuit connected to the coupling means for providing a display indication when any one or more of the target assemblies has been struck.

DETAILED DESCRIPTION OF THE INVENTION

Figure 1:
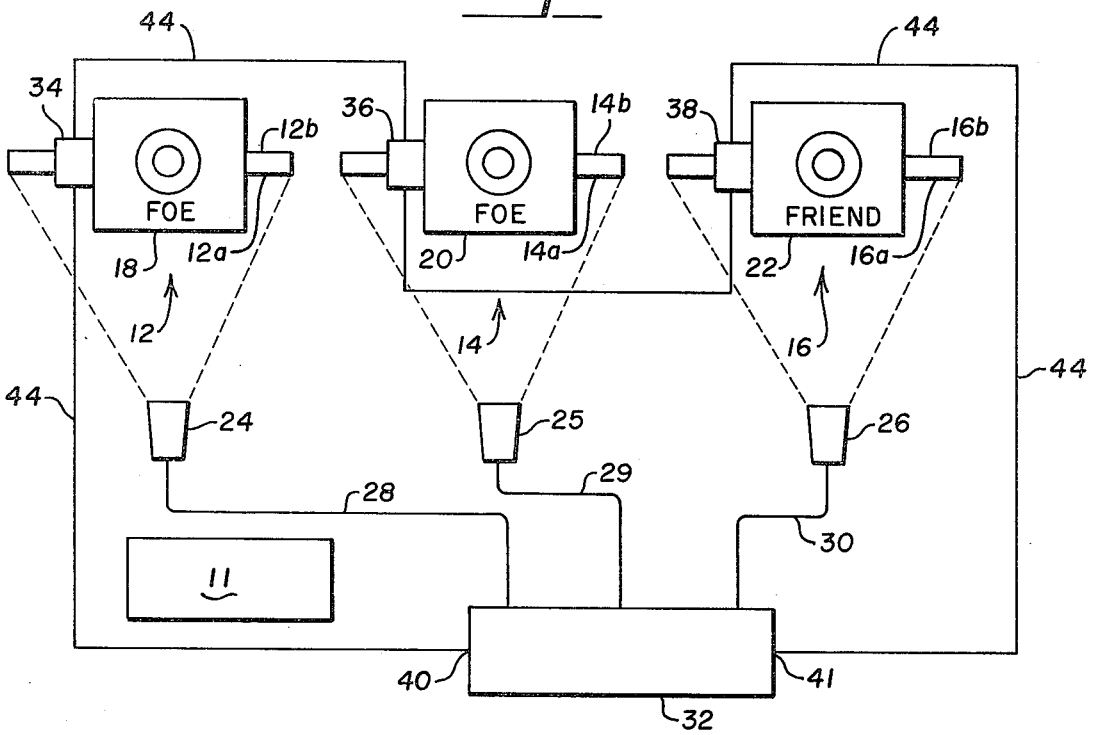
FIG. 1 is a simplified block diagram showing the elements of a typical target system embodying my invention.

Turning now to FIG. 1, the general layout of the system is shown. The shooter is positioned in a firing area 11 from which he can view a plurality of targets designated generally as 12, 14 and 16. In FIG. 1, the targets are shown in simplified top view. In one embodiment of the system, each of the targets 12, 14 or 16 has targets on two faces 12*a* and 12*b*, 14*a* and 14*b* or 16*a* and 16*b* thereof. In this embodiment, the target on the "a" side of the target may be that of a "foe", while that on the "b" side may be that of a "friend." A solenoid or motor drive 18, 20 or 22 is used to move or rotate each of the targets between the "a" and "b" positions under the control of separate electronics which are well known in the prior art and are not specifically described herein.

The targets 12, 14 and 16 may be positioned for selective illumination by light sources 24, 25 and 26 which are connected by means of cables 28, 29 and 30 to a control unit 32. One or more targets are selectively illuminated under the general control of the control unit 32 in either a random or an operator controlled sequence. A selected target is briefly illuminated by its associated light and the shooter positioned at the shooting station 11 is confronted with a decision as to whether or not the target illuminated is a "friend" or "foe" target. Sensors 34, 36 and 38 are mounted on targets 12, 14 and 16, respectively, to sense the impact of a bullet upon its associated target. The sensors can normally be mounted on the target frame and can detect bullet impact on the target without the necessity of the sensor being directly struck by the bullet. A circuit, such as the one described in my U.S. Pat. No. 4,129,299, can be used to avoid counting hits on the target support frame, rather than the target. Each of the input sensors 34, 36 or 38 has the configuration of a normally closed switch which is opened momentarily to an open circuit configuration upon impact by a bullet.

An important feature in the target scoring system is that a single sensor interconnection loop 44 can be used to interconnect all of the targets in the system. Each of the switches 34, 36 and 38 are wired in a series array, both ends of which are connected to two terminals 40 and 41 of control panel 32. It will be realized that only one connection to the control electronics is necessary where the other end of the loop and the control unit 32 are both also connected to ground. Conductor 44 is used to interconnect each of the switches.

In the normal configuration before any firing has occurred, each of the switches 34, 36 and 38 is in the normally closed position and a short-circuit current path is provided between terminals 40 and 41. If any one of the targets is struck, its associated sensor 34, 36 or 38 is at least momentarily open-circuited and the change in resistance between terminals 40 and 41 can be interpreted by the electronics as being a "hit". As will be seen by the more detailed discussion below, it is also possible to indicate which of the targets 12, 14 or 16 has, in fact, been struck by the bullet as well as being able to distinguish between the striking of a "friend" and a "foe" target.

Figure 2:
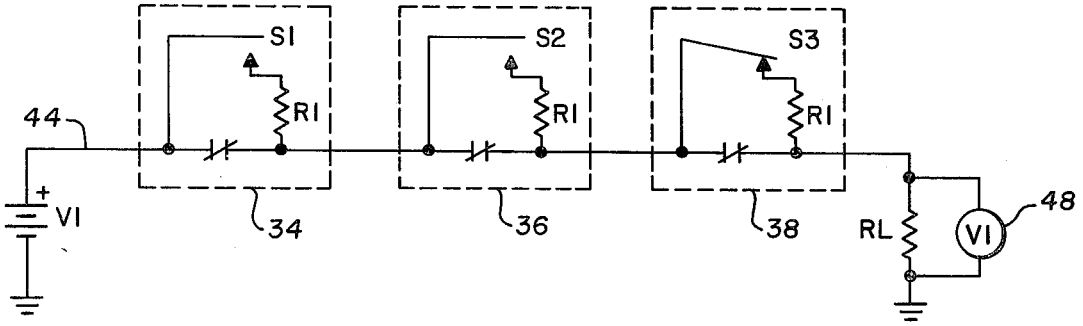
FIG. 2 is a schematic of one embodiment of a target system providing different outputs for hits on "foe" targets and hits on "friend" targets.

FIG. 2 is a simplified schematic diagram of a circuit used in a system of the type shown in FIG. 1 to distinguish between hits on "friend" targets and hits on "foe" targets. The three sensors 34, 36 and 38 are connected in series by conductor 44 in the same manner as shown in FIG. 1. Each of the sensors includes therein an additional switch $S_1$, $S_2$ or $S_3$, respectively, connected in series with a resistor $R_1$ with the switch-resistor combination connected in parallel with the normally closed terminals of the sensor 34, 36 or 38. Further means, not shown, are used to move switches $S_1$, $S_2$ or $S_3$ into the closed position when the face "a" or "b" corresponding to "foe" of the target 12, 14 or 16 is exposed to the shooter at the shooting station 11.

Figure 3:
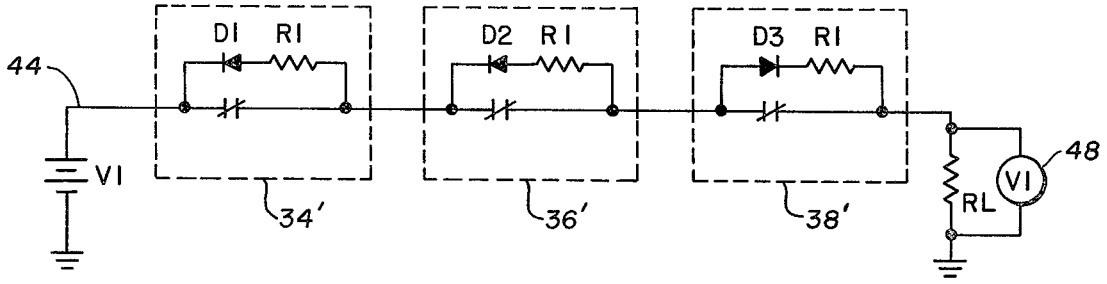
FIG. 3 is a schematic of another embodiment of a target system providing different outputs for hits on "foe" targets and hits on "friend" targets.

In the alternate embodiment shown in FIG. 3, the switches $S_1$, $S_2$ and $S_3$ have been replaced by diodes $D_1$, $D_2$ and $D_3$. In order to switch a particular target from a "friend" to "foe" condition, it is only necessary to "turn it around" to reverse the diode polarity. This can be done by placing the diode and resistor on a reversible board or plug which can be readily reversed. When the diode is forward biased, it is equivalent to the closing of the switch. When the diode is reverse biased, it is equivalent to the open switch condition. As shown in FIG. 3, sensors 34' and 36' are in "friend" target positions while sensor 38' is in the "foe" target position.

The circuits shown in FIGS. 2 and 3 operate in the following manner. If either of the "friend" targets 12 or 14 as shown in FIGS. 2 and 3 is struck, its associated sensor 34 or 36 will be moved to an open circuit configuration interrupting the flow of voltage from the battery $V_1$ to the series resistor $R_1$ resulting in a switching of the voltage across $R_L$ measured by the volt meter 48 from voltage source $V_1$ to a zero voltage.

In the event that the foe target 16 is struck as shown in FIGS. 2 and 3, the open circuiting of the sensor switch contacts in sensor 38 does not result in a complete open circuit on the path between the voltage source $V_1$ and the resistor $R_L$ across which the volt meter 48 is connected to measure voltage. When the contacts of sensor 38 are opened, resistor $R_1$ is placed into series with resistor $R_L$ so that the voltage across $R_L$ switches from $V_1$ to a reduced voltage determined by the ratio of the voltage divider formed of resistor $R_1$ and resistor $R_L$. If, for example, $R_1$ and $R_L$ have equal resistance, the voltage sensed by volt meter 48 will be equal to one-half of $V_1$ in the event that a "friend" target is struck while the voltage will drop to zero in the event that a "foe" target is struck. Thus, it is possible with a plurality of targets connected in a series array to detect whether any one of the targets has been struck and also to determine, using a single conductor interconnection loop, whether the target struck was a "friend" or "foe" target.

DETECTOR CIRCUIT

A practical circuit utilizing the principles discussed above is shown in FIGS. 4A and B. The circuit shown in FIGS. 4A and 4B serves a similar function to the volt meter 48 shown in FIG. 2. The sensor array can be energized by connecting one end of conductor 44 to terminal 40 of the control box 32 shown in FIG. 1 and the signal at that input is dependent upon the condition of the series loop interconnecting the sensor switches 34, 36 and 38. The signal at terminal 40, which is determined by the condition of the switches, is applied to the positive terminals of a pair of comparators 50 and 51 which are both on the same integrated circuit chip having the terminal designations as shown in the Figure for a LM339 low offset voltage quad comparator.

The input to the comparator comes from terminal 40 which is connected to the positive supply through resistor $R_2$ and to ground through the series loop or array of switches 34, 36, 38, etc. The levels at which the level detector is triggered are determined by the voltage dividers $R_3$, $R_4$ for level detector 50 and $R_5$, $R_6$ for level detector 51. The reference for comparator 50 is set lower than comparator 51. The comparator output terminals at pins 13 and 14 are connected to the positive supply through resistors $R_7$ and $R_8$, respectively, to input terminals of a pair of NAND gates 54 and 56, which may be mounted on the same integrated circuit chip and have the pin designations shown in FIG. 4*a* which correspond to the pin designations used for the type 4011 2 input quad NAND gate.

NAND gate 58 is connected as an inverter between the output of comparator 51 and the input at pin 13 of NAND gate 54.

The detection circuit operates as described below. The normal voltage level present at terminal 40 is the supply voltage used to energize the series connection of sensor switches 34, 36 and 38. When the signal is at a low voltage, it is indicative of the condition with all sensor 34, 36 and 38 switches closed, and the outputs at pin 13 of comparator 50 and at pin 14 of comparator 51 are both at low voltage.

If a "foe" sensor is arbitrarily defined as one where no parallel resistor is connected, and if that sensor receives an impact, the voltage at 40 will rise toward the supply voltage and the outputs of both comparators will switch to a positive voltage.

If a "friend" sensor with a parallel resistor having a value equal to $R_2$ is struck, the voltage at 40 will be one-half of the supply voltage and between the thresholds of the two comparators. The output of comparator 50 will then be a positive voltage, while the output of comparator 51 will remain at a low voltage.

Thus, we have three input conditions: both comparators with "0" outputs when there are no hits, both comparators at "1" outputs when a "foe" sensor is struck, and comparator 50 is at "1" while comparator 51 remains at "0" when a "friend" sensor is struck. The remainder of the circuitry in FIG. 4 is one embodiment of circuitry for converting those three logic states into useful shooting range scoring outputs.

LOGIC CIRCUIT

When no target has been hit, both comparator outputs are "0" and the outputs of NAND gates 54 and 56 are ones. When a "foe" sensor is struck, the output of both comparators switches to a "1" and NAND 56 switches to a "0" while NAND 54 remains at "1". When a "friend" sensor is struck, comparator 50 is a "1", comparator 51 is a "0" inverted by gate 58 to a "1", so the output of gate 54 switches to a "0" while the output of gate 56 stays at "1".

Figure 4A:
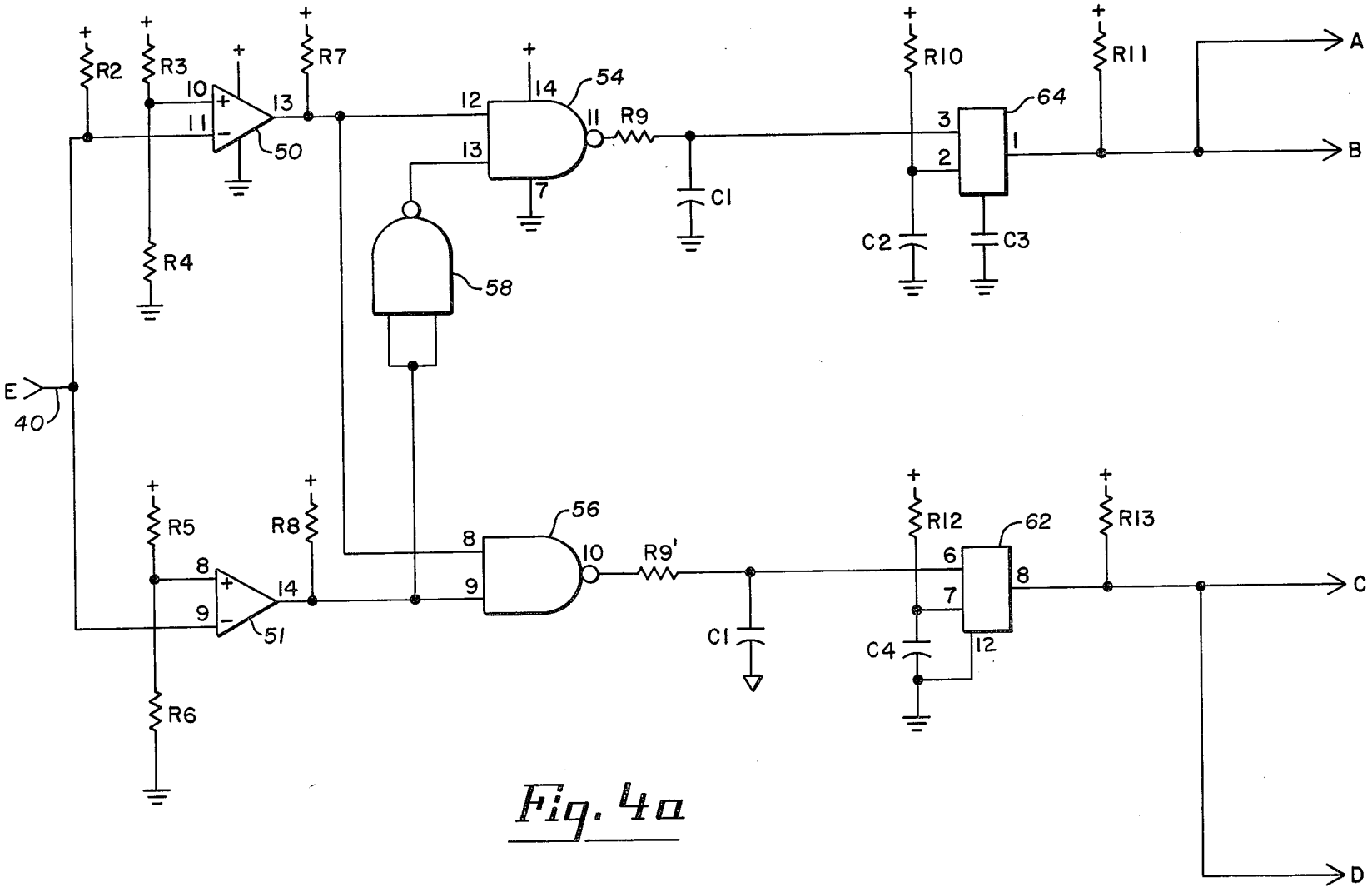
FIGS. 4A and 4B are a schematic of circuitry for hit scoring in the above system.
Figure 4B:
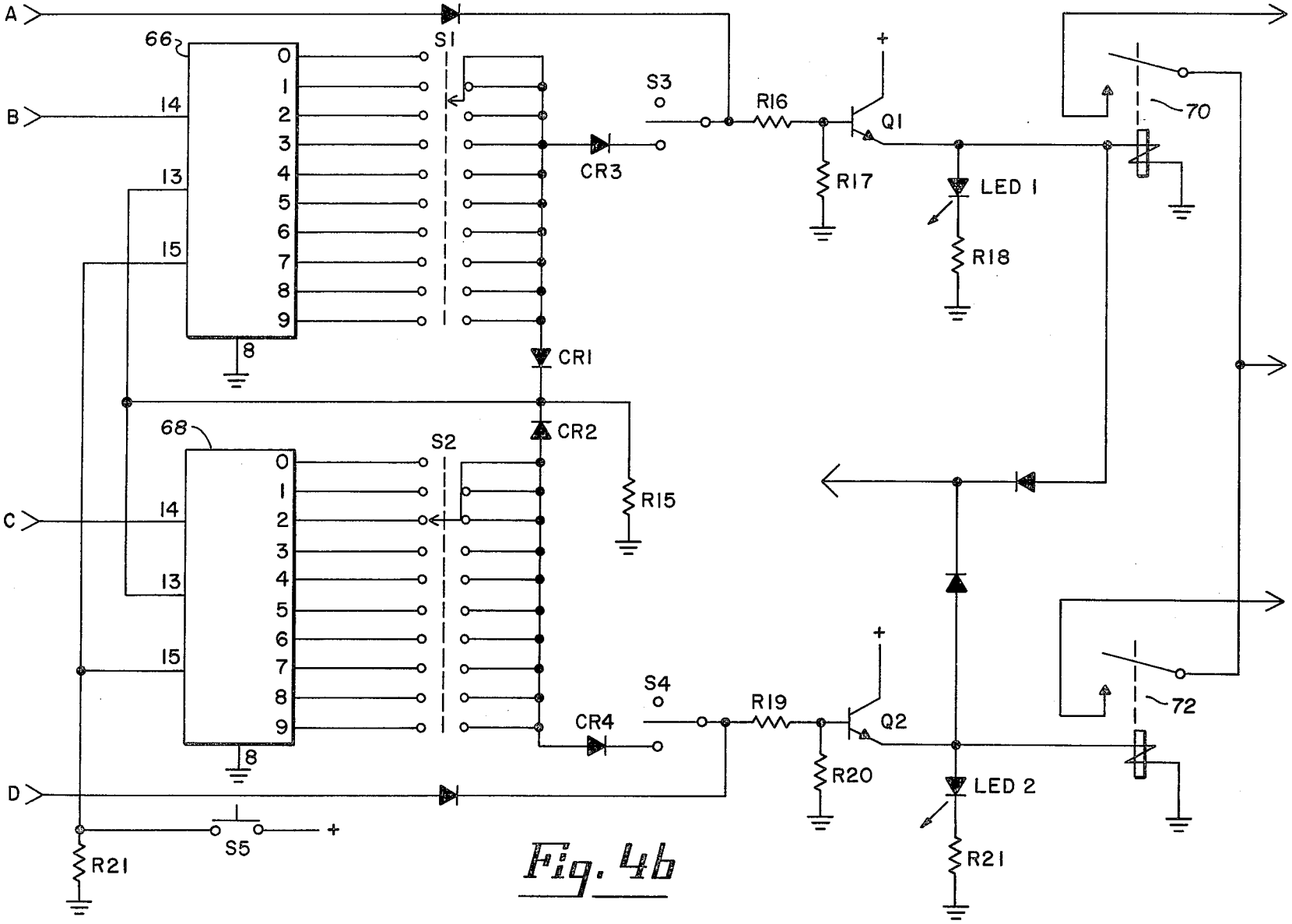

The boxes labelled 62 and 64 in FIGS. 4A and 4B are one shot or pulse shaping circuits, such as the LM558 manufactured by National Semiconductor, can provide a pulse output upon receipt of a trailing edge pulse input at terminals 6 and 3, respectively, of circuits 62 and 64. The positive pulse outputs at pins 8 and 1, respectively, are connected to circuitry shown in FIG. 4B. The RC combinations of $R_{12}$ and $C_4$ and $R_{10}$ and $C_2$ are used to set the pulse width of the output pulse of the one shots, while the $R_9$ and $C_1$ and $R_9'$ and $C_1'$ circuits connected between the output of the NAND gates and the input of the one shots are used to smooth the output of the NAND gates to minimize the noise delivered to the input of the one shots. In some instances, it may be desirable to have $R_9$ and $R_9'$ mechanized as variable resistors to permit adjustment.

The pulse output of the one-shot circuit 64 is connected to the non-inverting clock input of a five stage Johnson counter 66.

Counter 66 and its companion 68 are both model number 4017 5-stage Johnson counters manufactured by Fairchild Semiconductor and others. The input at pin 14 of the counter triggers when the signal switches from a low to a high level. The other input terminal at pin 13 of the counter is triggered by the change from a high to a low signal. Pin 13 is connected to the OR gate of diode $CR_1$ and $CR_2$ and resistor $R_{15}$. The anode of diode $CR_1$ is connected to the wiper of a switch $S_1$ while the anode of $CR_2$ is connected to the wiper of switch $S_2$. Both switches $S_1$ and $S_2$ can be set by an operator to select a particular output stage of the five-stage Johnson counter once the output of the counter reaches the stage selected by its associated switch.

The signal applied to the inverting clock input 68 acts as an inhibit signal and prevents the counter from further advancing as additional pulses are received. If switches $S_3$ and $S_4$ are set in the lower position, the counter output is passed through diodes $CR_3$ and $CR_4$, respectively, to drive transistors $Q_1$ and $Q_2$ through base resistors $R_{16}$ and $R_{19}$, respectively. Resistors $R_{17}$ and $R_{20}$ are connected between the base and ground of transistors $Q_1$ and $Q_2$. The output of transistors $Q_1$ and $Q_2$ drive light emitting diodes 1 and 2, respectively, which are connected to the emitters of $Q_1$ and $Q_2$ and utilize series resistors $R_{18}$ and $R_{21}$ to limit the current therethrough. Thus, when either the "friend" counter 66 or the "foe" counter 68 reaches its selected number of hits, as determined by $S_1$ or $S_2$, the counters are inhibited from counting further hits, and an output indication is given on either $LED_1$ or $LED_2$ as to which counter reached its selected hit scoring threshold first.

In addition to the visible indication on the LEDs, further indicator means can be driven by solenoid switches 70 and 72, as shown, which may be used to activate buzzers, lights or other indicators not explicitly shown herein.

The counters 66 and 68 can be reset by closing switch $S_5$ to apply a voltage to reset terminals 15 of both counters. The pins are connected together and grounded through resistor $R_{21}$ in addition to being connected through switch $S_5$, when closed, to the positive supply.

Switches $S_3$ and $S_4$ can be positioned in the upper position shown in FIG. 4B so that the pulse output of the one-shot 64 and 62 can be connected directly to transistors $Q_1$ and $Q_2$, respectively, to count each hit as it is recorded by the hit detecting circuitry shown in FIG. 4A.

SCORING CIRCUITRY

Figure 5:
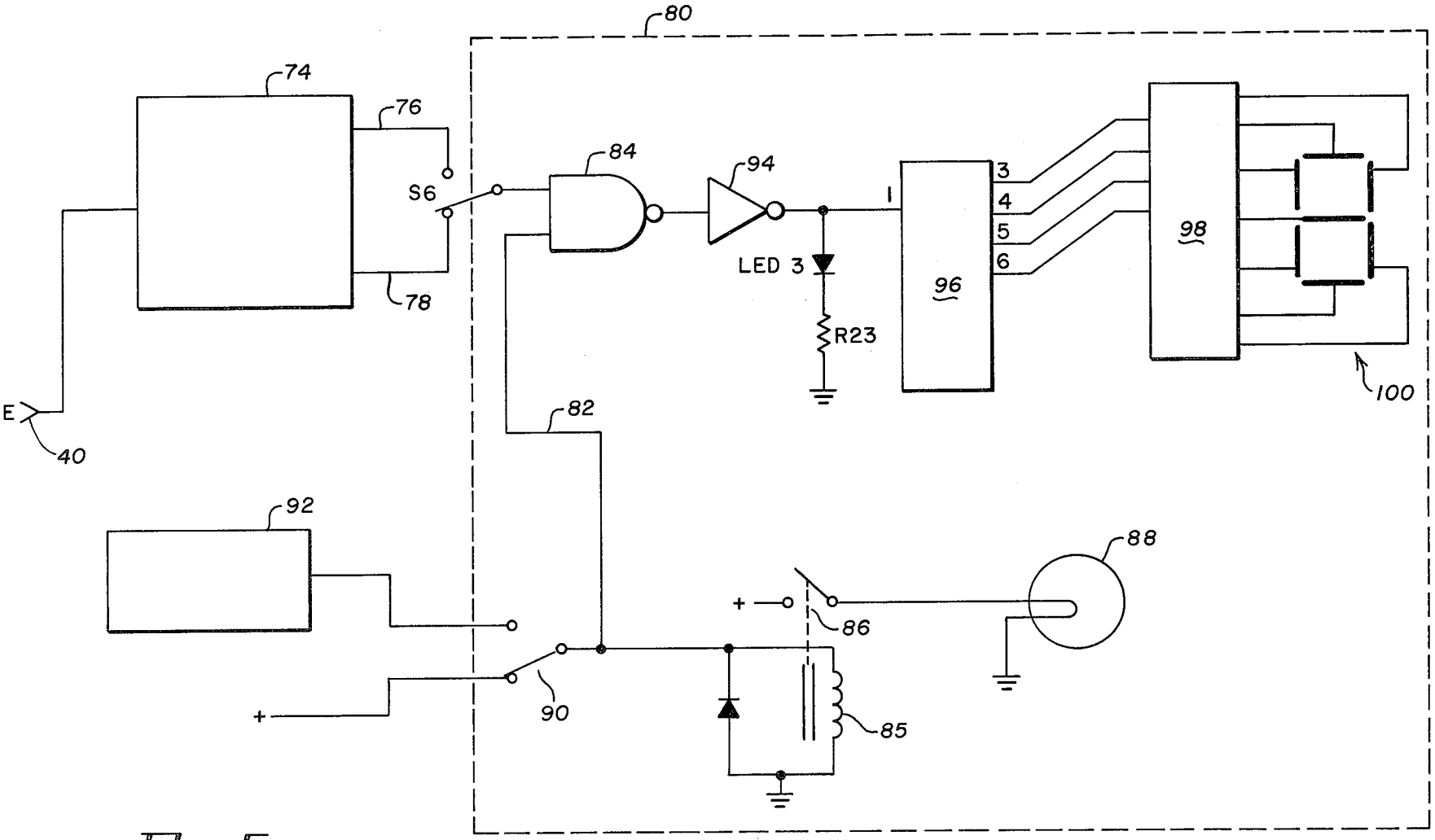
FIG. 5 is a schematic of the driver stage for controlling the target illumination lights used in the system.

FIG. 5 shows additional circuitry used with the detector circuitry in FIG. 4A for implementing a scoring system used with a simulation of a night fighting target system. In a night fighting system, a plurality of targets is provided, which are selectively illuminated by either the operator or by an automatic method. The night fighting scoring system, shown in FIG. 5, provides an indication of the number of hits made on each of the individual targets. This can be done utilizing the single wire series interconnection of the targets by using the fact that the illuminated target is, in nearly all instances, the target which has been struck.

Turning now to the details in FIG. 5, the input terminal 40 is connected to the series connection of the various target sensors in the same manner as shown in FIG. 1, for example. The circuitry in FIG. 4A is shown in simplified block form in the box labelled 74, while the friend outputs at "A" and "B" in FIG. 4A are labelled 76, and the "foe" outputs at "C" and "D" are labelled 78.

In order to simplify FIG. 5, only the scoring circuitry for a single target is shown in detail. Separate discrimination and scoring circuitry is required for each individual target, thus, if six targets are used, it will be necessary to provide six switches corresponding to $S_6$ and six of the other items within the discrimination and scoring circuitry box 80, except for some of the integrated circuits which can be shared between two target sensors, as discussed below.

$S_6$ is set in one of two positions, depending upon whether the target with which it is associated is a "friend" or a "foe" target. If it is a "foe" target, it is set in the position shown in FIG. 5, so that only "foe" hits are passed on to the discrimination circuitry. The hit signal is ANDed with a further signal on conductor 82 by NAND gate 84. The signal on conductor 82 is taken from the high side of a solenoid 85 used to drive a switch 86 which, in turn, when energized or closed, provides the excitation voltage to a lamp 88 which is part of one of the luminaires, such as 24, 25 or 26, shown generally in FIG. 1. When the lamp 88 is illuminated by actuating solenoid 85 and closing switch 86, the associated target is illuminated and, according to the assumption, any hits detected on a "foe" target while this particular target is illuminated are assumed to be scored against this target. The illumination of a particular target can be controlled manually under control of a switch, such as switch 90, shown in FIG. 5, which can connect directly to the positive voltage supply in one position and to further circuitry generally designated as 92, which generates a plurality of signals to selectively energize a single "friend" and a single "foe" target at any particular time. Circuitry for performing this function can be mechanized in a number of different ways, not considered to be a part of the present invention.

When a "foe" hit is detected by the circuitry in 74 and the associated target is lit so that a positive voltage appears on conductor 82, the output of NAND gate 84 inverted by inverter 94 is positive, thereby energizing $LED_3$ through resistor $R_{23}$ and applying a positive input voltage to pin 1 of a part number 4518 dual four-bit decade counter 96 manufactured by Fairchild and others, which provides output at pins 3, 4, 5 and 6, which, in turn, is used to drive a 4055 seven-segment display chip 98 and display 100. The other half of the decade counter can be used to drive a similar display when driven by a derived signal from another one of the sensors. Thus, it can be seen that the sensor interconnection and detector circuit of the present invention can be combined with logic and discrimination circuitry to provide an indication of which target in a series of targets has been struck if information is also available as to which of the targets is being illuminated at the time that a hit is recorded by the sensing circuitry 74.

I claim:

1. A hit indicating apparatus for a multiple target shooting range, comprising, in combination:

an electrical circuit, including;

power means;

indicator means;

at least two target means, each of which includes hit sensor means, said sensor means including an input lead and an output lead, said sensor means joined in a series array so that the initial input and final output leads of said sensors of said series connect into said electrical circuit whereby when any target is struck a display indication is provided by said indicator means.

2. A hit indicating apparatus for a multiple target shooting range, comprising, in combination:

an electrical circuit, including:

power means;

indicator means;

at least two target means, each of which includes hit sensor means, said sensor means including an input lead and an output lead, said sensor means joined in a series array so that the initial input and final output lead of said series connect into said electrical circuit whereby when any target is struck a display indication is provided by said indicator means; and said sensor means providing a change in impedance displayable by said indicator means.

3. The hit indicating apparatus of claim 2 wherein said hit sensors means includes a normally closed switch means for providing an open circuit indication between said input lead and said output lead of said hit sensor when said target means is struck.

4. The apparatus of claim 3 wherein each of said switch means includes resistance means connected to said sensor means input lead and output lead and wherein said indicator means includes detector means connected to receive an output signal from said final output lead of said series and provide a display indication when the output signal exceeds a predetermined level.

5. The apparatus of claim 4 wherein each of said resistance means has a resistor whose value is electrically distinguishable from each other by said detector means.

6. The apparatus of claim 5 wherein each of said target means includes a "friend" target image and a "foe" target image, means coupled to said target means for selectively manipulating a selected target to expose the "friend" or the "foe" image; means coupled to said sensor means for setting the high impedence state of said sensor means at a first level when the "friend" image of said target means is exposed and at a second level when the "foe" image is exposed; and said indicator means providing a first output indication when the impedance of said series array changes to a first level indicative of a hit on a "friend" target and providing a second output when the impedance of said series array changes to said second level, indicative of a hit on a "foe" target.

7. The apparatus of claim 6 wherein light means for selectively lighting at least one of said target means and a plurality of counter means are provided, each of said counter means corresponding to one of said target means and each of said counter means including indicator means for energizations to record a hit when a "foe" hit is recorded and when its corresponding target means is lighted.

* * * * *